US005310183A

United States Patent [19]

Glikmann

[11] Patent Number: 5,310,183

[45] Date of Patent: May 10, 1994

[54] TRANSPARENT CUBE PUZZLE

[76] Inventor: Kevin L. Glikmann, 16607 Calneva Dr., Encino, Calif. 91436-4129

[21] Appl. No.: 955,364

[22] Filed: Oct. 1, 1992

[51] Int. Cl.[5] ..... A63F 9/08

[52] U.S. Cl. ..... 273/153 S; 273/157 R

[58] Field of Search ..... 273/153 R, 153 S, 156

[56] References Cited

U.S. PATENT DOCUMENTS

| | | | |
|---|---|---|---|
| 785,665 | 3/1905 | Coe | 273/109 |
| 1,978,107 | 10/1934 | Hoffmann | 273/156 |
| 3,510,134 | 5/1970 | Brooks et al. | 273/157 A |
| 3,845,959 | 11/1974 | Kosarek | 273/153 S |
| 4,009,882 | 3/1977 | Rader | 273/156 |
| 4,424,971 | 1/1984 | Clark | 273/153 S |
| 4,488,725 | 12/1984 | Clark | 273/153 S |
| 4,511,144 | 4/1985 | Roberts | 273/153 S |
| 4,861,036 | 8/1989 | Watanabe | 273/153 R |

FOREIGN PATENT DOCUMENTS

| | | | |
|---|---|---|---|
| 1174050 | 8/1985 | U.S.S.R. | 273/157 A |

*Primary Examiner*—Vincent Millin

*Assistant Examiner*—Steven B. Wong

*Attorney, Agent, or Firm*—W. Edward Johansen

[57] ABSTRACT

A transparent cube puzzle which includes a transparent cube-shaped container, a first number of cubes and a plurality of designators. The first number is defined by $(n^3-n)$ with n being the maximum number of cubes in a row. The transparent cube-shaped container has six faces each of which has a second number of holes equally-spaced apart thereon. The second number is defined by $n^2$. Each cube has six faces and is formed out of a transparent material. One first designator is coupled to each face of each cube. Each face of the cubes has an indentation thereon and a first designators is disposed in the indentation of each face of each cube. Four first sets of the first designators each of which consists of the second number of tabs which are of a color which is distinctive within the four first sets. Two second sets of the first designators each of which consists of a third number of tabs which are of a color which is distinctive within the four first sets and within the two second sets. The third number is defined by $(n^2-1)$.

5 Claims, 2 Drawing Sheets

Fig. 1.
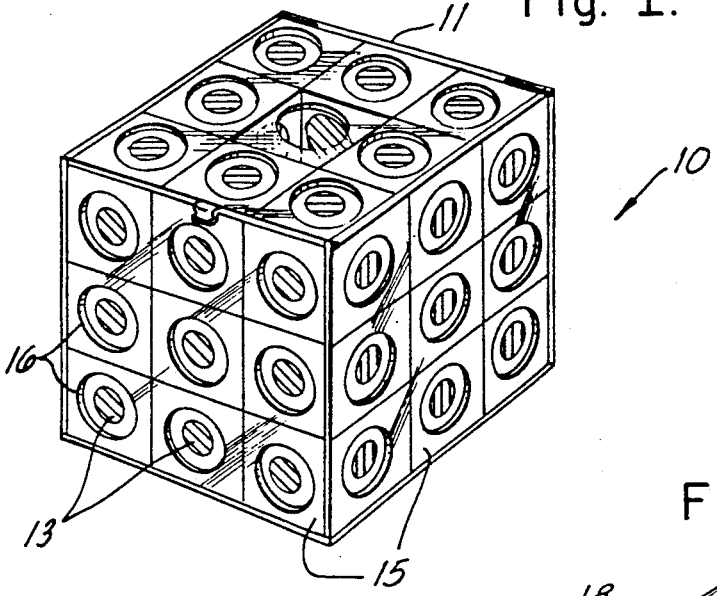
Fig. 2.
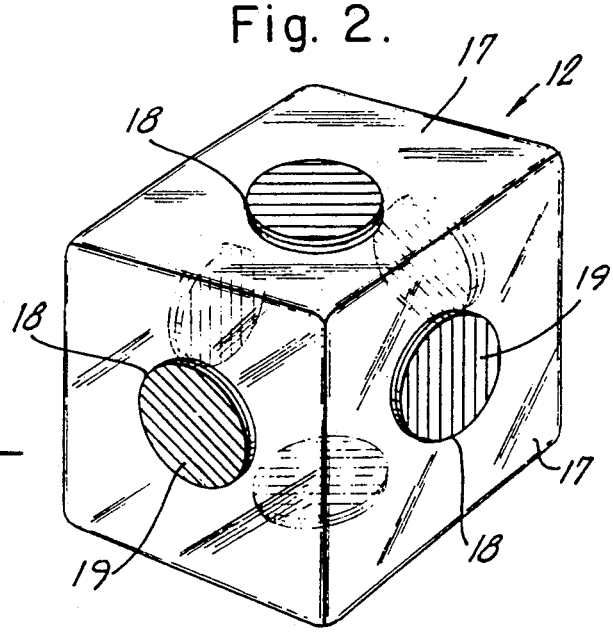
Fig. 3.
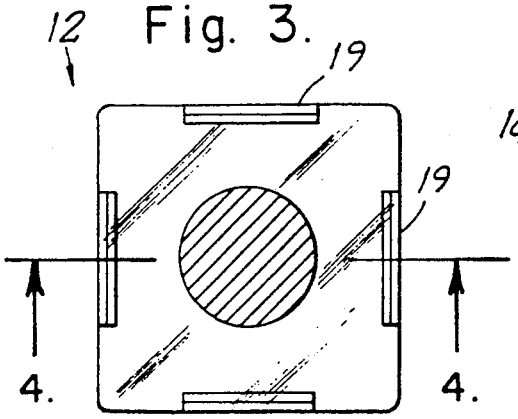
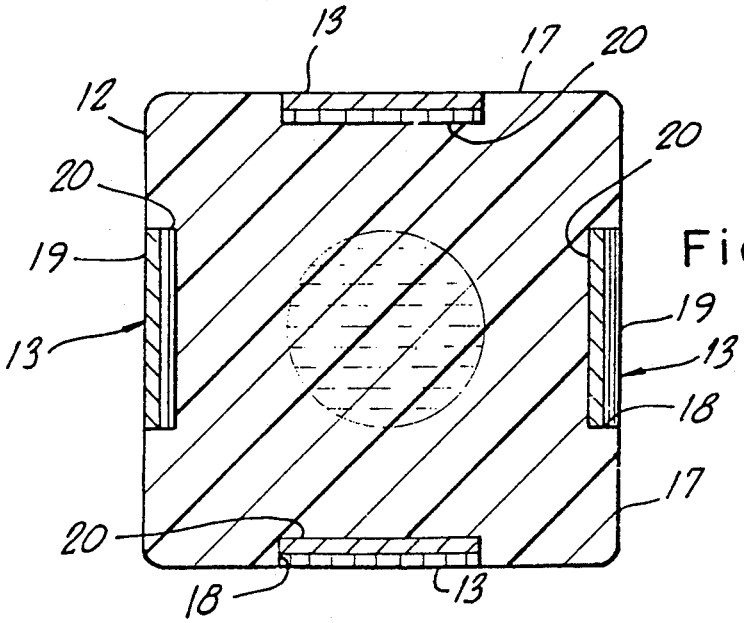
Fig. 4.

TRANSPARENT CUBE PUZZLE

BACKGROUND OF THE INVENTION

The field of the invention is cube puzzles.

Hand-manipulated cube puzzles includes a plurality of cubes and a cube-shaped container. These cube puzzles have increased in popularity and ingenuity of development with a view toward the increasing interest of individuals in the mental challenges in solving such cube puzzles and the manual dexterity required for the same. In all of these cube puzzles there has always been one less cube than is necessary to completely fill the container with cubes. There have previously been devised games and puzzles in which pieces of a predetermined shape have been movable in two or even three dimensions within an exterior housing into a variety of spacial relationships with respect to each other.

Existing cube puzzles include "Rubik's Cube" which while challenging is inordinately complex both in concept and physical manufacture. On the other end of the scale with respect to shifting piece puzzles, the well-known planar array of fifteen slidable squares in a four by four matrix pattern provides a challenge that is far more readily solved than when effecting solution of a position problem in a three dimensional environment.

U.S. Pat. No. 3,845,959 teaches a cube puzzle which includes a plurality of cubes of a uniform size are movable within a volume of constant thickness defined within an outer housing of the same shape as the movable cubes. In the cube puzzle the sides of the movable cubes are colored selectively so as to provide a different colored pattern for each solution of the cube puzzle.

U.S. Pat. No. 785,665 teaches a puzzle apparatus which includes a playing-board divided into variously-colored spaces and a set of movable playing-pieces arranged upon the playing-board. The number of the playing-pieces is one less than the number of spaces upon the playing-board. Each playing-piece has a color corresponding to the color of a space upon the board. Each playing-piece is provided with an opening through which the color of the space over which the playing-piece is moved will be exposed.

U.S. Pat. No. 4,036,503 teaches a cube puzzle in which the cubes may be rotated, as well as slid from an occupied space into an adjacent space. In this cube puzzle the cubes are slid or rotated within the container by manipulating the container itself, such as by rotating, tilting, twisting or tapping on the container.

U.S. Pat. No. 4,424,971 teaches a manipulative cube puzzle which includes a cube-shaped container and a plurality of cubes. The manipulative cube puzzle has at least one horizontal tier of cubes in which the cubes may be slid, rotated or tumbled at the option of the player. The cubes are marked on at least part of the faces with various colors, letters, numbers, designs or symbols in order to permit the player to arrange the cubes in combinations of varying complexity.

U.S. Pat. No. 4,488,725 teaches a cube puzzle in which a container is divisible into a given number of spaces and filled with one less cube than the number which would be required to fill the container. The space, which is not occupied by a cube, provides a space into which an adjacent cube may be slid, which in turn creates a space having a different location in the container. Initially, the cubes are placed either at random or jumbled. The object of the game is to manipulate the cubes to a position which will spell words, or to arrange the cubes in a numerical sequence.

U.S. Pat. No. 1,518,889 is an example of a two tier puzzle in which the faces of the individual cubes are printed or impressed with letters and numerals. The cubes must be arranged in such a manner that it is possible to spell certain words and make certain numerical arrangements.

SUMMARY OF INVENTION

The present invention is directed to a cube puzzle which includes at least a first number of cubes, a plurality of designators and a transparent cube-shaped container. The first number is defined by $(n^3-n)$ with n being the maximum number of cubes in a row. The transparent cube-shaped container has six faces each of which has a second number of holes equally-spaced apart thereon. The second number is defined by $n^2$. Each cube has six faces. At least one of the designators is coupled to a face of the cubes. The cubes can be manipulated and moved within the transparent cube-shaped container.

In a first aspect of the present invention each cube is formed out of a transparent material.

In a second aspect of the present invention each of the six faces of the cubes has an indentation thereon and one of the first designators is disposed in the indention of each of the six faces of each of the cubes.

In a third aspect of the present invention at least four first sets of the first designators each of which consists of at least the second number of tabs which are of a color which is distinctive within the four first sets.

In a fourth aspect of the present invention at least two second sets of the first designators each of which consists of at least a third number of tabs which are of a color which is distinctive within the four first sets and within the two second sets. The third number is defined by $(n^2-1)$.

In a fifth aspect of the present invention at least four third sets of the first designators each of which consists of at least the second number of tabs which are a color which is distinctive within the four first sets, within the two second sets and within the four third sets.

In a sixth aspect of the present invention at least two fourth sets of the first designators each of which consists of at least the third number of tabs which are of a color which is distinctive within the four first sets, within the two second sets, within the four third sets and within the two fourth sets.

In a seventh aspect of the present invention the puzzle cube includes a plurality of second designators one of which is placed beneath each of the first designators. Each of the second designators corresponds to one of the first designators on an opposing face of the cube on which it is placed.

In an eighth aspect of the present invention there are exactly the first number of cubes disposed in the transparent cube-shaped container so that each of the cubes can be rotated within the transparent cube-shaped container.

In a ninth aspect of the present invention the puzzle cube is used with a stand which includes a base and a pole which is coupled to the base.

Other aspects and many of the attendant advantages will be more readily appreciated as the same becomes better understood by reference to the following detailed description and considered in connection with the accompanying drawing in which like reference symbols designate like parts throughout the figures.

The features of the present invention which are believed to be novel are set forth with particularity in the appended claims.

DESCRIPTION OF THE DRAWING

FIG. 1 is a perspective view of a transparent cube puzzle which includes a plurality of cubes in accordance with the first embodiment.

FIG. 2 is a perspective view of one of the cubes of the transparent cube puzzle of FIG. 1.

FIG. 3 is a side elevational view of the cube of FIG. 2.

FIG. 4 is a side elevational view in cross-section of the cube of FIG. 2 taken taken along line 4—4 of FIG. 3.

DESCRIPTION OF THE PREFERRED EMBODIMENT

Figure 5:
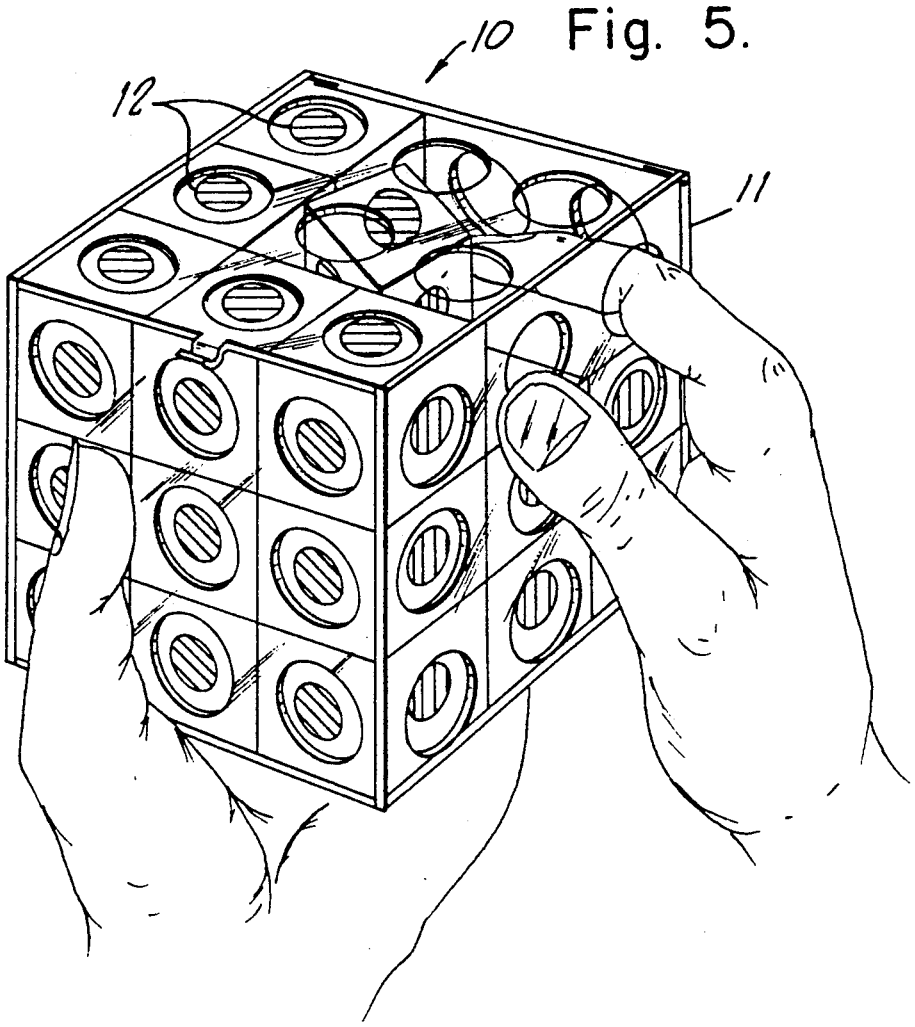
FIG. 5 is schematic drawing of the transparent cube puzzle of FIG. 1 as a hand holds its in order to rotate one of the cubes thereof.

Referring to FIG. 1 in conjunction with FIG. 2 a puzzle cube 10 includes a transparent cube-shaped container 11, twenty four cubes 12 and one hundred forty four first designators 13. The transparent cube-shaped container 11 has six faces 15 each of which has nine holes 16 which are equally-spaced apart thereon. Each cube 12 has six faces 17 and each face 17 of each cube has an indentation 18 thereon. Each cube 12 is formed out of a transparent material. The cubes 12 are disposed in the transparent cube-shaped container 11. One of the first designators 13 is disposed in the indention 18 of each face 17 of each of the cubes 12.

Referring to FIG. 3 in conjunction with FIG. 2 four first sets of the first designators 13 each of consists of at least nine tabs 19 which are of a color which is distinctive within the four first sets. Two second sets of the first designators 13 each of which consists of at least eight tabs 19 which are of a color which is distinctive within the four first sets and within the two second sets. Four third sets of the first designators 13 each of which consists of at least nine tabs 19 which are of a color which is distinctive within the four first sets, within the two second sets and within the four third sets. Two fourth sets of the first designators 13 each of which consists of at least eight tabs 19 which are of a color which is distinctive within the four first sets, within the two second sets, within the four third sets and within the two fourth sets.

Referring to FIG. 4 in conjunction with FIG. 3 the puzzle cube 10 also includes one hundred forty four second designators 20 one of which is placed beneath each of the first designators 13. Each of the second designators 20 corresponds to the first designator 18 on the opposing face 17 of the cube 12 on which it is placed.

Referring to FIG. 5 in the puzzle cube 10 there are exactly twenty four cubes 12 disposed in the transparent cube-shaped container 11. Each cube 12 can be rotated within the transparent cube-shaped container 11.

Figure 6:
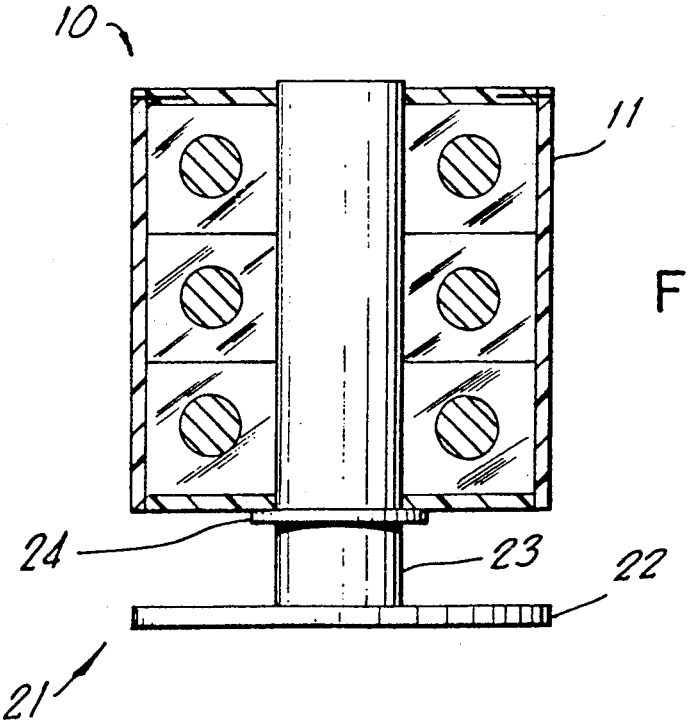
FIG. 6 is a side elevational view in cross-section of the transparent cube puzzle of FIG. 1.

Referring to FIG. 6 in conjunction with FIG. 1 the puzzle cube 10 may be used with a stand 21 which includes a base 22, a pole 23 and a mount 24. The pole 23 is coupled to the base 22. The mount 24 is coupled to the pole 23 and supports the puzzle cube 10. A hinge 25 couples one of the faces 17 of the transparent cube-shaped container 11 to another face and a latch 26 couples one of the faces 17 of the cube-shaped container 11 to still another face.

In an alternative embodiments a puzzle cube includes a transparent cube-shaped container, a first number of cubes and a second number of first designators. The first number is defined by $(n^3-n)$ with n being the maximum number of cubes in a row of the transparent cube-shaped container. The second number is defined by $6(n^3-n)$. Each face of the transparent container has a third number of holes 16 which are equally-spaced apart thereon. The third number is defined by $n^2$.

From the foregoing it can be seen that a transparent puzzle cube has been described. It should be noted that the sketches are not drawn to scale and that distance of and between the figures are not to be considered significant.

Accordingly it is intended that the foregoing disclosure and showing made in the drawing shall be considered only as an illustration of the principle of the present invention.

What is claimed is:

1. A puzzle cube comprising:

a. a cube-shaped container having six faces each of which having a first number of holes equally-spaced apart in a square matrix thereon wherein said first number is defined by $n^2$ with n being greater than 2;

b. a second number of cubes disposed in said cube-shaped container, each of said cubes having six faces, wherein said second number is less than $(n^3)$ and wherein each of said cubes is formed out of a transparent material;

c. a plurality of first designators each of which is placed on one of said six faces of said cubes; and d. a plurality of second designators each of which is placed beneath one of said first designators whereby each of said second designators corresponds to one of said first designators disposed on an opposing face of said cube on which it is placed.

2. A puzzle cube according to claim 1 wherein each of said six faces of at least one of said cubes has an indentation thereon and wherein at least one of said first designators is disposed in said indention.

3. A puzzle cube according to claim 1 wherein two second sets of said first designators each of which consists of at least a third number of tabs which are of a color which is distinctive within said four first sets and within said two second sets wherein said third number is defined by $(n^2-1)$.

4. A puzzle cube according to claim 3 wherein four third sets of said first designators each of which consists of at least said first number of tabs which are of a color which is distinctive within said four first sets, within said two second sets and within said four third sets.

5. A puzzle cube according to claim 4 wherein two fourth sets of said first designators each of which consists of at least said third number of tabs which are of a color which is distinctive color within said four first sets, within said two second sets, within said four third sets and within said two fourth sets.

* * * * *